United States Patent [19]

Nishizawa et al.

[11] Patent Number: 4,547,133

[45] Date of Patent: Oct. 15, 1985

[54] VARIABLE CAPACITY COMPRESSOR

[75] Inventors: Kazutoshi Nishizawa, Toyoake; Masashi Takagi, Kariya; Yasuyuki Nishi, Obu, all of Japan

[73] Assignee: Nippondenso Co., Ltd., Kariya, Japan

[21] Appl. No.: 471,726

[22] Filed: Mar. 3, 1983

[30] Foreign Application Priority Data

Mar. 5, 1982 [JP] Japan ..... 57-35303

[51] Int. Cl.[4] ..... F04B 1/28; F04B 49/02; F16K 31/04

[52] U.S. Cl. ..... 417/270; 417/292; 417/297; 251/129.11; 251/82

[58] Field of Search ..... 417/292, 297, 270, 507; 251/82, 133; 62/196 C

[56] References Cited

U.S. PATENT DOCUMENTS

| | | | |
|---|---|---|---|
| 2,715,992 | 8/1955 | Wilson | 62/196 C |
| 2,865,557 | 12/1958 | Hartwell | 417/507 |
| 3,535,053 | 10/1970 | Jednacz | 417/298 |
| 4,376,377 | 3/1983 | Duron | 417/298 |
| 4,403,921 | 9/1983 | Kato | 417/297 |
| 4,413,955 | 11/1983 | Kato | 417/297 |

*Primary Examiner*—William L. Freeh

*Attorney, Agent, or Firm*—Cushman, Darby & Cushman

[57] ABSTRACT

A variable capacity compressor has a low-pressure chamber, a high-pressure chamber receiving the discharge of some cylinders and a discharge chamber receiving the discharge of other cylinders. An on-off valve between the discharge chamber and low-pressure chamber is actuated by an electric device, such as a servo motor. An electric circuit controls the servo motor so that it is driven for a certain time period in response to a signal to change the compressor capacity. A device operative with the on-off valve moves the valve forward or backward according to the rotation of the servo motor and makes the motor idle when it reaches the fore or back end of movable space. A plunger is inserted in a pressure room which receives the fluid pressure from the high-pressure chamber, and the device for moving the on-off valve is placed in the pressure room so that it directly or indirectly moves the on-off valve and can also operate as an opening or closing device for control of the valve of a connecting port between the high-pressure chamber and the pressure room.

17 Claims, 4 Drawing Figures

VARIABLE CAPACITY COMPRESSOR

BACKGROUND OF THE INVENTION

1. Field of the Invention

The present invention relates to a variable capacity compressor, which may be used for such equipment systems as an automotive air conditioning system.

2. Description of the Prior Art

Since a conventional refrigerant compressor used for an automotive air conditioning system is generally rotated by the driving force of an automobile engine, the compressor is formed to rotate at an unnecessarily high speed when the automobile is driving at a high speed or in an accelerating stage.

In such cases, the cooling performance of the air conditioning system is excessive. Conversely, when the engine is idling, the engine is subjected to an excessive load by the compressor, and therefore, control of the cooling equipment is more complicated and the fuel consumption of the engine is increased. Accordingly, compressors with variable discharge capacities have been required.

SUMMARY OF THE INVENTION

A primary object of the present invention is to provide a compact compressor with variable capacity.

Another object of the present invention is to provide a variable capacity compressor with an on-off valve which opens or closes a discharge chamber for receiving the discharge of some cylinders and a low-pressure chamber in order to change the discharge capacity.

A further object of the present invention is to provide a variable capacity compressor which employs a compact servo motor to open or close an on-off valve by use of high pressure gas.

The compressor according to the present invention achieves these objects.

A variable capacity compressor in accordance with the present invention has plural reciprocating pistons, a housing which includes plural cylinder members to support said pistons, a low-pressure chamber, a high-pressure chamber and a discharge chamber receiving discharge through the discharge ports of some of said cylinder members, a check valve which only allows the fluid flowing from said discharge chamber to said high-pressure chamber, an on-off valve disposed between said low-pressure chamber and said discharge chamber, and discharge valves which are positioned against said discharge ports, a pressure room formed between said housing and said on-off valve and having a connecting port to connect said pressure room and said discharge chamber, and an electric device to open and close said connecting port for switching the operation of said on-off valve which opens and closes said discharge ports and the connection between said low-pressure chamber and said discharge chamber.

Use of the servo motor to actuate the on-off valve permits, elimination of an on-off valve that can not be moved without high-pressure fluid.

An electric circuit may be incorporated in the compressor to control the electric current for driving the servo motor. The servo motor may be driven for a certain time in response to a signal to change discharge capacity. Thus constructed, an on-off switch is not required near the complicated on-off valve of the compressor, which results in improved stability of operation and simplicity of the equipment.

A device may be associated with the on-off valve to move the valve forward or backward according to the rotation of the servo motor, and make the servo motor idle when it reaches the fore or back end of the movable space. This device can prevent application of an unnecessary load to the servo motor.

A plunger may be inserted to a pressure room which receives the high fluid pressure, and the device for the on-off valve may be placed in the pressure room so that it directly or indirectly moves the on-off valve and can also operate as an opening or closing device for control of the valve of a connecting port between the high-pressure chamber and the pressure room. A smaller servo motor with a lower output or an electromagnetic valve may be used to control the high pressure fluid sent to the pressure room.

BRIEF DESCRIPTION OF THE DRAWINGS

These and other objects and many of the attendant advantages of this invention will be readily appreciated as the same becomes better understood by reference to the following detailed description when considered in connection with the accompanying drawings, in which.

PREFERRED EMBODIMENTS

Figure 1:
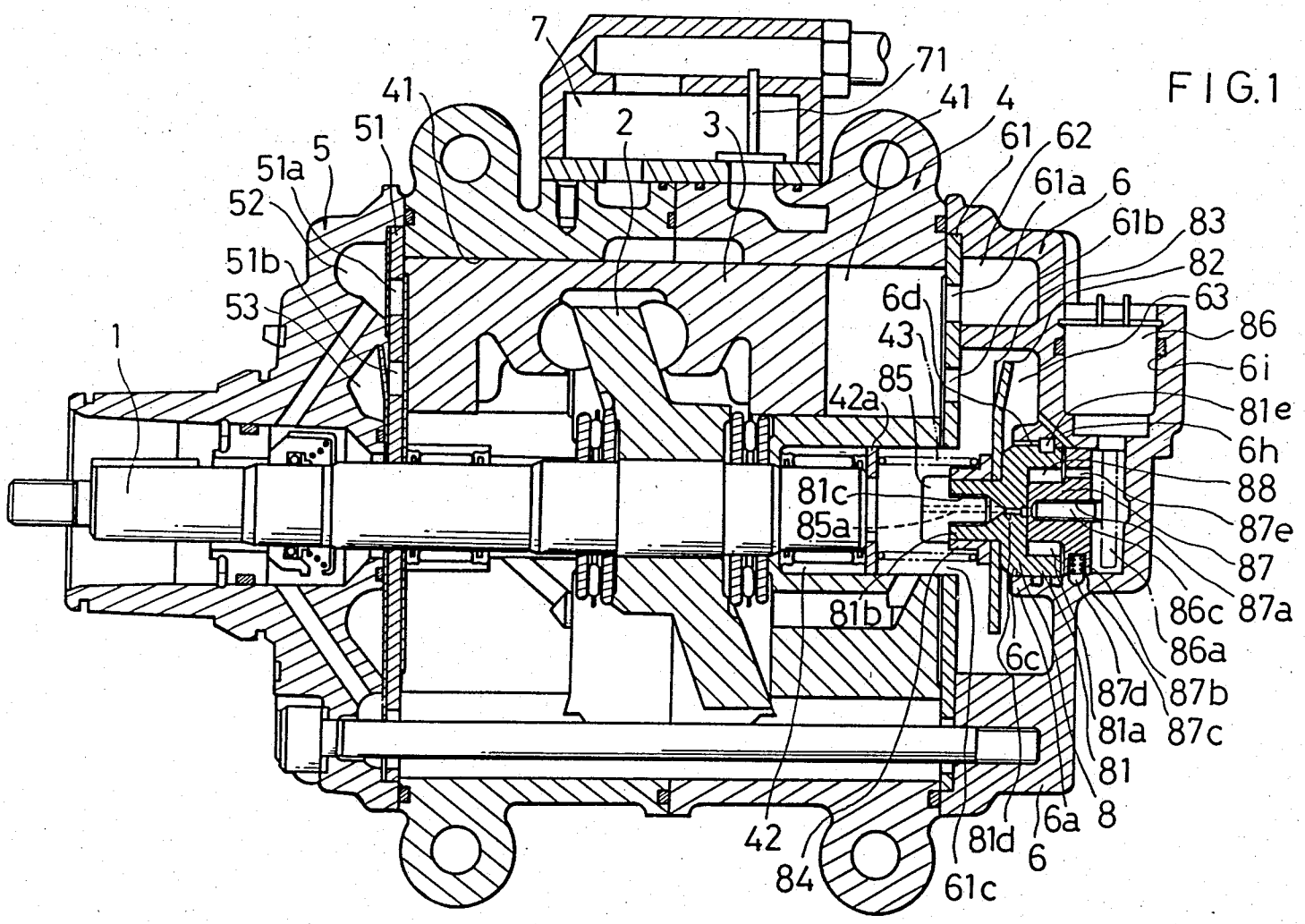
FIG. 1 is a cross-sectional view showing a variable capacity compressor of the invention in accordance with the preferred embodiment.
Figure 3:
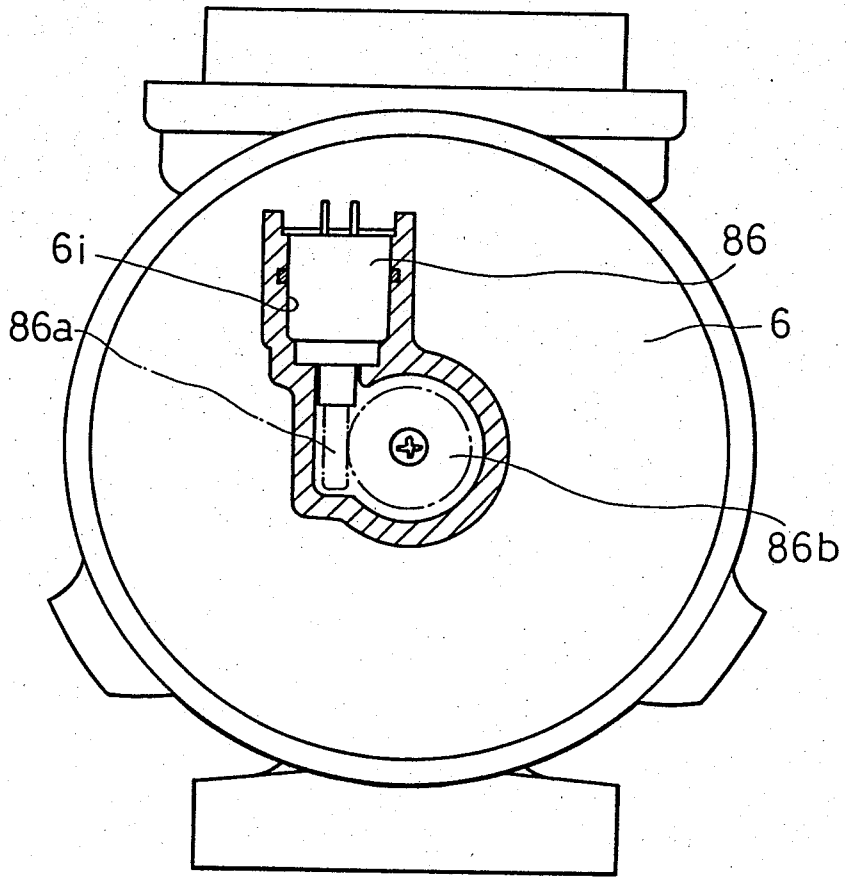
FIG. 3 is a sectional view showing the positional relationship between the servo motor, worm shaft and worm gear of FIG. 1.

The first preferred embodiment of the invention will be described with reference to FIGS. 1–4. In FIG. 1, 1 designates a rotary shaft, which is connected to an automobile engine through an electromagnetic clutch and is rotated by the driving power of the engine. A slanting disk 2 made of ferrous metal and molded in semicircular shape is integrated with the rotating shaft 1 and rotates asymmetrically. This asymmetrical rotation of the slanting disk 2 causes pistons 3 to reciprocate through shoes and balls. A housing 4 includes ten cylinders 41, five for each side and disposed around the shaft to support the reciprocating motion of the pistons 3. The left and right portions of the housing 4 shown in FIG. 1 are jointed through an O-ring after the individual portions have been separately molded by die casting. The first side housing 5 and the second side housing 6 are airtightly bonded to respective sides of the husing 4. The first valve plate 51 is disposed between the first side housing 5 and the housing 4, and the intake ports 51*a* and discharge ports 51*b* in the valve plate 51 connect the cylinder 41 with the first intake chamber 52 and the first discharge chamber 53 which are formed at the side of the first side housing 5. The first intake chamber 52 is connected to the low-pressure chamber supplied with refrigerant gas vaporized in an evaporator which is not shown. The first discharge chamber 53 is connected to a high-pressure chamber 7 which is disposed in the side of the center of the housing 4. The second valve plate 61 is situated between the second side housing 6 and the housing 4. The second valve plate 61 is a disk having five intake ports 61*a* for fluid intake in the outermost portion, five discharge ports 61*b* for fluid discharge inside the intake ports 61*a*, and a large connecting port 61*c* in the center portion is connected to a bearing gap 42 of the housing 4.

The second intake chamber 62 and the second discharge chamber 63 are formed between the second side housing 6 and the second valve plate 61. The intake ports 61*a* are open to the second intake chamber 62, the discharge ports 61*b* open to the second discharge chamber 63, and the center connecting port 61*c* open to the center portion of the second discharge chamber. The second discharge chamber 63 is connected to the high-pressure chamber 7 through the check valve 71. A cylindrical guide 6*a* is disposed in the center of the second discharge chamber 63 in the second side housing 6, and a cavity 6*b* is sectioned by the guide 6*a*. Into this guide 6*a*, a plunger 81 of the valve member 8 is inserted. And the cavity 6*b* and the plunger 81 define a pressure room 88. The plunger 81 comprises a cylinder 81*a* having an opening cavity at one end and a center projecting portion 81*b* at the other end. A screw hole 81*c* is formed in the projection 81*b*, and a slit 81*d* is open from the screw hole 81*c* to the bottom of the cylinder 81*a*. Into the center projecting portion 81*b*, are inserted a star-like retainer 82 and a discharge valve 83, together comprising the main part of the valve member 8. Besides them, a fastening ring 84 is inserted there, which also serves as a spring retainer, and is fixed with a bolt 85 screwed into the screw hole 81*c*. A narrow connecting hole 85*a* passes through the axis of the bolt 85. The diameter of the connecting hole 85*a* is approximately 0.5 mm–1.8 mm. The valve member 8 can move axially with the plunger 81 guided by the guide 6*a*.

FIG. 1 shows the state where the valve member 8 is situated at the right side. In this case, the second discharge chamber 63 is connected to the bearing gap 42 of the housing 4 through the central connecting part 61*c* of the second valve plate 61, and also connected to the cylinder 41 through the discharge port 61*b* of the second valve plate. If the valve member 8 is pushed against the left side, the discharge valve 83 of the valve member 8 contacts the second valve plate 61 and the discharge ports 61*b* and the connecting port 61*c* are closed. The bearing gap 42 is connected to the low-pressure chamber, where a spring retainer 42*a* is disposed. Springs 43 are fitted between the spring retainer 42*a* and the fastening ring 84 of the valve member 8*m* so that the springs 43 may push the valve member 8 in the right direction in the figure.

A groove 6*d* is formed along the axis on the inner surface 6*c* which defines the cavity 6*b* of the guide 6*a*, and the head of a positioning pin 81*e*, attached to the side of the plunger 81, is inserted into the groove 6*d*. Therefore, rotation of the plunger 81 around the shaft is prevented by the positioning pin 81*e* and the groove 6*d*, so that the plunger moves only axially. At the bottom of the cavity 6*b* of the guide 6*a*, a worm shaft 86*a* of a servo motor 86 is rotatablly supported, in the direction vertical to the axis of the cavity 6*b*. A worm gear 86*b* is rotatably supported at the bottom of the cavity 6*b*, and engaged to the wormshaft 86*a* and driven by the shaft 86*a*. A driving screw 86*c* is fastened to the axis of the worm gear, coaxially with the gear axis.

Inside the plunger 81, which is inserted in the cavity 6*b* of the guide 6*a*, a rotary ring 87 is attached to the cavity 6*b*, in an axially movable and rotatable state. The rotary ring 87 is a disk with a projection in the center on one side, and its circumference contacts with the inner surface 6*c* of the cavity 6*b*. On the opposite side of the projection of the rotary ring 87, a screw hole 87*a* is formed, to which the driving screw 86*c* of the worm gear 86*b* is engaged. A small groove 87*b* is defined on the circumference of the rotary ring 87. A spring 87*c* and a moving pin 87*d* are inserted into the groove 87*b*. The spring 87*c* pushes the sliding pin 87*d* to the outer direction. A port 87*e* is formed, passing through both sides of the rotary ring 87. As shown in an enlarged scale in FIG. 2, a pair of parallel ring-shaped grooves 6*e* and 6*f* and a spiral groove 6*g* connecting the grooves 6*e* and 6*f*, are formed on the inner surface of the cavity 6*b* of the guide 6*a*. The head portion of the sliding pin 87*d* of the rotary ring 87, is placed in these grooves 6*e*, 6*f* and 6*g* and slides along the grooves 6*e*, 6*f* and 6*g*. The rotary ring 87 rotates with the sliding pin 87*d*, and it can move axially by its spiral rotation in the spiral groove 6*g*. A connecting port 6*h* is opened to the space between the spiral grooves 6*g* of the guide 6*a*, and connects the second discharge chamber 63 with the pressure chamber 88 at the bottom of the cavity 6*b* of the guide 6*a*.

Figure 2:
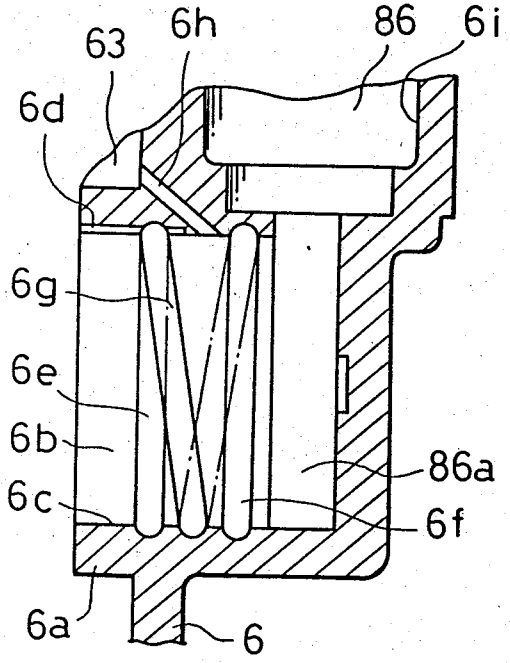
FIG. 2 is a partially enclosed view showing grooves of the inner surface 6*c* of the guide 6*a* of FIG. 1.

A servo motor 86 is disposed within a cavity 61 wich is defined adjacent to the outer surface of the housing 6. FIGS. 1 and 2 show cross-sectional views of the compressor along its axis, but the servo motor 86 is shown for its cross-sectional view along the central axis of the motor.

Figure 4:
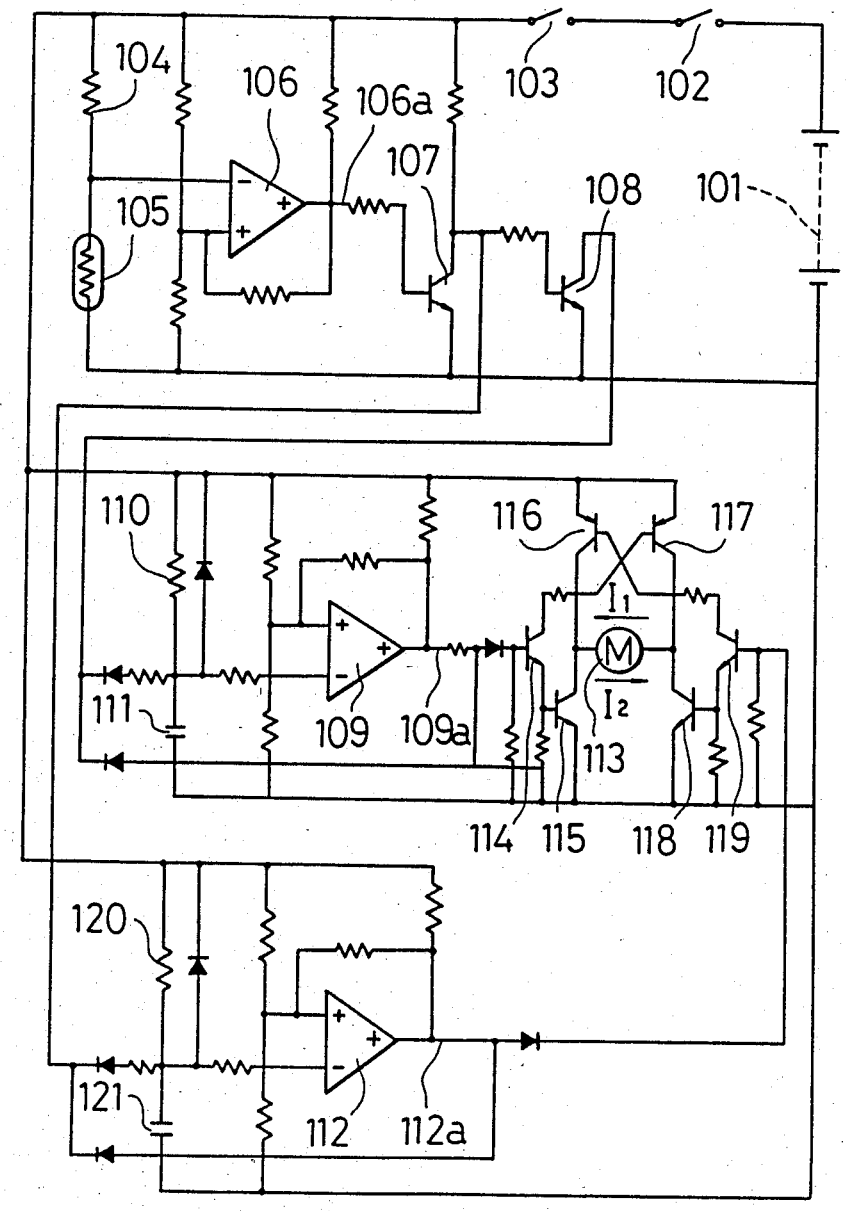
FIG. 4 is a circuit diagram showing the electric circuit for driving the servo motor.

FIG. 4 shows the circuit to control the servo motor 86. In the circuit diagram shown in FIG. 4, 101 designates a battery, 102 an ignition switch, and 103 an input switch of the air conditioning system. 104 is a setting resistance which sets the injection air temperature, 105 is a temperature sensor for detecting the injection air temperature, 106 is a comparator operated by a signal from the temperature sensor 105, and 107, 108, 114, 115, 116, 117, 118, and 119 are transistors. 110 and 111 are, respectively, a resistor and a condenser, which set predetermined time intervals, and 120 and 121 are another pair of a resistor and a condenser which also set predetermined time intervals. 109 and 112 are comparators which are operated by the signals of the resistor 110 and the condenser 111, and of the resistor 120 and the condenser 121, respectively.

This circuit is operated as follows. When the ignition switch 102 and the input switch 103 of the air conditioning system are turned on and the air temperature is high, the output 106*a* of the comparator 106 indicates a high value by input of the resistor 104 and the temperature sensor 105. Accordingly, the transistor 107 is turned on and the transistor 108 is turned off. The condensers 111 and 121 are not sufficiently charged just after the switches 102 and 103 are turned on. And the outputs 109*a* and 112*a* of the comparators 109 and 112 are at high levels. Now when the transistor 107 is on and the transistor 108 is off, the transistors 114, 115 and 117 become on, and the transistors 116, 118 and 119 become off, and therefore current flows to rotate the motor in the I1 direction. After a certain period, the condenser 111 is charged and the output 109*a* of the comparator 109 changes to a low level. Accordingly, the transistors 114, 115 and 117 become off and the current to the motor becomes zero.

When the temperature in an automobile room becomes low and the air injection temperature of an air conditioning system is lower than the predetermined temperature, the output 106*a* of the comparator 106 changes to a low level by the input of the temperature sensor 105. Therefore, the transistor 107 becomes off and the transistor 108 becomes on. The condenser 121 begins to be charged, but is not sufficiently charged and therefore the output 112*a* of the comparator 112 remains at a high level. The transistors 116, 118 and 119 become on and the transistors 114, 115 and 117 become off, thereby current flows in I2 direction, opposite to the former case. And the motor 113 will rotate in a direction opposite to the former case. After a certain period, the condenser 121 is charged and the output 112*a* of the comparator 112 changes to a lower level. Then, the transistors 116, 118 and 119 become off, and the current to the motor 113 becomes zero and the motor stops. When the transistor 108 becomes on, the condenser 111 will be discharged. At that time, in the circuit shown in FIG. 4, the rotating direction of the motor 113 is determined by the input of the temperature sensor 105, and the motor is driven for a certain period until the condensers 111 and 121 are charged.

The variable capacity compressor of the present embodiment is constructed as described above. Its functions will be described in the following.

When the engine and the rotary shaft 1 are engaged through the electromagnetic clutch, the rotary shaft 1 and the slanting disk 2 begin to rotate. In response to the rotation of the slanting disk 2, the pistons 3 move up and down within the cylinders 41. By this reciprocal motion of the pistons 3, the refrigerant gas of the first intake chamber 52 is induced into the cylinders 41 through the connecting ports 51*a* of the first valve plate 51 and the intake valve. When the pistons 3 begin to compress the gas and the intake valve is closed, the refrigerant gas in the cylinders 41 is compressed to a high-temperature and a high-pressure. The gas is then discharged to the first discharge chamber 53 through the connecting port 51*b* and the discharge valve. This high-temperature and high-pressure gas enters the high-pressure chamber 7 by its own pressure, and is then sent to the condenser (not shown), through a discharge passage such as a discharge service valve and a connecting pipe.

When the valve member 8 in the second side housing 6 is in the state as shown in FIG. 1, the discharge valve 83 of the valve member 8 is apart from the second valve plate 61. Therefore, the connecting ports 61*b* always connect the cylinders 41 to the second discharge chamber 63. The second discharge chamber 63 is also connected to the bearing gap 42 and the low-pressure chamber, through the central connecting port 61*c* of the second valve plate 61. Accordingly, the pistons 3 at the side of the second side housing 6, do not compress the refrigerant gas in the cylinders 41, but are in idling stage. The high-pressure chamber 7 and the second discharge chamber 63 are closed by the check valve 71.

When the room temperature (injected air temperature) exceeds a predetermined temperature in the state described above, the output 106*a* of the comparator 106 is changed to a low level by the input of the temperature sensor 105 in the electric circuit in FIG. 4. Thereby the motor 113 (the servo motor 86 in FIG. 1–FIG. 3) rotates in one direction for a certain period. The servo motor 86 in FIGS. 1–3, rotates in one direction and this rotation causes the worm gear 86*b* to rotate counterclockwise, through the shaft 86*a*. The driving screw 86*c* rotates integrally with the worm gear 86*b*, and introduces counterclockwise rotation to the rotary ring 87, also pushing against the ring in the direction parallel to the shaft to the left side in FIG. 1. In the rotary ring 87, the sliding pin 87*d* can move only along the grooves 6*e*, 6*f*, and 6*g* on the inner surface 6*c* of the guide 6*a*.

As the sliding pin 87*d* stays in the circular groove 6*f* at the right end in FIG. 1, the sliding pin 87*d* (and also the rotary ring 87) rotates counterclockwise integrally with the driving screw 86*c* without moving axially along the circular groove 6*f*. When the moving pin 87*d* moves along the circular groove 6*f* and arrives at the point intersected by the spiral groove 6*g*, the sliding pin 87*d* moves into the spiral groove 6*g* from the groove 6*f* because the rotary ring 87 (and the sliding pin 87*d*) is rotationally pushed to the left direction in FIG. 1. And the sliding pin 87*d* slides along the spiral groove 6*g* so that the rotary ring 87 may be driven to the left direction in FIG. 1, rotating counterclockwise. In this case, the driving screw 86*c* rotates relative to the rotary ring 87. The rotary ring 87 shifts to left, thereby the connecting port 6*h* between the second discharge chamber 63 and the pressure room 88 is opened to the room 88 and the plunger 81 moves to the left of the upper portion in FIG. 1. The rotary ring 87 is pushing against the plunger 81 until the sliding pin 87*d* moves into the circular groove 6*e* at the left end. When the sliding pin 87*d* comes in the circular groove 6*e* at the left end, the ring 87 does not move axially but rotates integrally with the driving screw 86*c*. The driving period of the motor shown in FIG. 4 is determined to be long enough for the sliding pin 87*d* of the rotary ring 87 to move from the circular groove 6*f* at the right end to the groove 6*e* at the left end. The current flowing in the motor is ceased after the sliding pin 87*d* moves in the circular groove 6*f* for a while, and the servo motor 86 stops its motion. The plunger 81 is moved by the pushing of the rotary ring 87, just before the discharge valve 83 comes in contact with the second valve plate 61. In this state, the discharge valve 83 begins to function as a valve, thereby the high-pressure fluid flows into the second discharge chamber 63 from the cylinder 41. The high-pressure fluid in the second discharge chamber 63 flows into the pressure chamber 88 through the connecting port 6*h* of the guide 6*a*. The high-pressure fluid pushes the plunger 81 through the connecting port 87*e* of the rotary ring 87. Therefore, the discharge valve 83 is pressed against the second valve plate 61, by which the connecting port 61*c* in the center of the second valve plate is completely closed. The pressure in the second discharge chamber 63 is increased to a value higher than that in the high-pressure chamber 7, and the check valve 71 is pushed to open. Thus, the high-pressure and high-temperature refrigerant gas flows into the high-pressure chamber 7 from the second discharge chamber 63. In this state, the present compressor is operating at 100% capacity. The high-pressure fluid in the pressure room 88 flows into the bearing gap 42 and the low-pressure chamber in the housing 4, through the connecting hole 81*d* in the center of the plunger 81 and the connecting hole 85*a* of the bolt 85. However, because the hole 85*a* of the bolt 85 is narrower than the connecting port 6*h* open to the pressure room 88, the pressure of the pressure room 88 is kept approximately the same as that of the second discharge chamber. The narrow connecting hole is formed within the bolt in the present embodiment, but it can be disposed in other portions.

When the room temperature in the automobile goes down and the injection air temperature is lower than a predetermined temperature, the output 106*a* of the comparator 106 changes to a higher level by the input from the temperature sensor 105 in the electric circuit shown in FIG. 4. Thus, the servo motor 86 shown in FIG. 1–FIG. 3 rotates in the opposite direction for a certain period, so that the sliding pin 87*d* of the rotary ring 87 slides along the circular groove 6*e* at the left end, then, through the spiral groove 6*g*, the pin moves into the circular groove 6*f* at the right end. The rotary ring 87 rotates with the sliding pin 87*d* and moves to the right. Thus, the rotary ring 87 moves to the right and closes the connecting port 6*h* which is open to the second discharge chamber 63 and the pressure room 88. Therefore, the supply of the high-pressure fluid to the pressure room 88 is stopped, while the fluid flows out from the pressure room 88 to the low-pressure chamber through the slit 81*d* of the plunger 81 and the connecting hole 85*a* of the bolt 85. The pressure of the pressure room 88 is gradually decreased, so that the plunger 81 is pushed to the right by the resilience of the spring 43, and the discharge valve 83 separates from the second valve plate 61, which results in the state shown in FIG. 1. As described before, the compressor is operating with 50% capacity in this state, in which compression is being made only in the left cylinder shown in the upper portion of FIG. 1.

When the rotary ring 87 is moved in a left direction in the figure, the connecting hole 6*h* is opened so that the refrigerant gas flows through 6*h*. Thereby the refrigerant gas flows into the right side of plunger 81 to press the plunger 81 in the left direction.

When the plunger 87 is moved in the right direction and established in the state as shown in FIG. 1, the connecting hole 6*h* is closed. Thereby the high pressure gas in the right side of 81 is no longer supplied and flows through the connecting hole to the lower pressure side so that 81 is pressed in the right direction by spring 43 which assists for light movement to the right thereof.

The device of the present invention uses an electric device to open and close an on-off valve, thereby varying the discharge capacity as explained above. Therefore, a high pressure passage, which connects the high pressure chamber 7 and the pressure room 88, is not necessary. Thus, the device can be simplified.

The servo motor of the device in the present embodiment is driven by the electric circuit for motor driving for a certain period to either direction, and no limit switch is disposed in the compressor to turn on or off the servo motor. Since such limit switch is eliminated, safety of the device is improved, and the device can be simplified and minimized. For particular use, a limit switch may be disposed in the compressor to detect the movement of the discharge valve directly or indirectly, and to make sequence control of the movement of the discharge valve. In the present embodiment, the rotary ring 87 is designed to be idling when the sliding pin 87*d* slides in the circular groove 6*e* or 6*f* on either side of the spiral groove 6*g*, thereby little unnecessary power is applied to the servo motor even when the driving period of the servo motor 86 is set longer than necessary to complete the movement of the rotary ring 87. If the driving period of the servo motor and the moving period of the rotary ring 87 can be synchronized, the circular grooves 6*e* and 6*f* are not necessary. The rotary ring 87 is driven by the driving screw 86*c* and by its rotation, rotating force and axial force are applied to the rotary ring 87. Therefore, the sliding pin of the rotary ring 87 reliably alters course from the circular grooves 6*e* or 6*f* to the spiral groove 6*g*. The ratio of axial force to rotating force can be optionally selected by changing the pitch of the driving screw 86*c*. In the mechanism in which guides are disposed in the end points of the spiral groove 6*g* intersected by the circular grooves 6*e* and 6*f* and the sliding pin 87*d* reliably alters course from the circular groove 6*e* or 6*f* to the spiral groove 6*g*, the rotary ring 87 needs only to be rotated in either of the rotating directions. The rotary ring 87 is not always required to rotate but is only required to move axially.

In the present embodiment, the discharge valve 83 is pressed against the second valve plate by use of the pressure of the high pressure fluid applied from the discharge chamber 63 to the pressure room 88. Accordingly, the resilience of the spring 43 or the pressure to the plunger 81 is not applied to the rotary ring 87, so that the rotary ring 87 can move axially without any influence of forces. This enables the servo motor 86 to be very small in size. In the design which allows use of a large size servo motor, the pressure room 88 is not always necessary but the rotary ring 87 may be constructed to make direct move of the discharge valve 83 in the axial direction.

The compressor used in the present embodiment is of a slanting disk type, but compressors of other types can be employed. The capacity of the compressor is varied by the input from the temperature sensor which detects the injection air temperature of the air conditioning system, but the capacity may be controlled by detection of other signals related to air conditioners, such as refrigerant temperature.

What is claimed is:

1. A variable capacity compressor, comprising:

plural reciprocating pistons;

a housing including plural cylinder members to respectively support each of said pistons, a low-pressure chamber, a high-pressure chamber and a discharge chamber receiving discharge through discharge ports in some of said cylinder members;

a check valve selectively allowing fluid to flow only from said discharge chamber to said high-pressure chamber;

an on-off valve disposed between said low-pressure chamber and said discharge chamber, and having discharge valves selectively disposable against said discharge ports;

a pressure room formed between said housing and said on-off valve and having a connecting port to connect said pressure room and said discharge chamber; and electric means for selectively opening and closing said discharge valves of said on-off valve against said discharge ports while also respectively closing and opening said connecting port, operation of said on-off valve selectively establishing connection between said low-pressure chamber and said discharge chamber so as to vary the capacity of said compressor, and wherein pressure from said discharge chamber is communicated through said opened connecting port to press on said on-off valve in a closing direction thereof.

2. A variable capacity compressor according to claim 1, wherein said on-off valve has a narrow connecting hole for connecting said pressure room and said low-pressure chamber.

3. A variable capacity compressor according to claim 2, wherein said electric means includes an electromagnetic valve.

4. A variable capacity compressor according to claim 2, wherein said electric means includes a servo motor.

5. A variable capacity compressor according to claim 3, further comprising:

an electric circuit for driving said servo motor for a certain time period in response to a signal to operate said on-off valve.

6. A variable capacity compressor according to claim 5, further comprising:

a device, to move said on-off valve, which moves forward or backward according to the rotation of said servo motor, said device causing said servo motor to idle when said on-off valve reaches the fore or back end of its movable space.

7. A variable capacity compressor according to claim 6, wherein said on-off valve has a plunger inserted in said pressure room which receives a fluid pressure from said high-pressure chamber, and said device is placed in said pressure room to move said on-off valve directly or indirectly and also to open or close a valve of a connecting port between said high-pressure chamber and said pressure room.

8. A variable capacity compressor according to claim 7, wherein said pressure room and said low-pressure chamber are connected by a narrow connecting slit.

9. A variable capacity compressor according to claim 1, wherein said electric means includes a valve member movably located in said pressure room which selectively moves said on-off valve to close while opening said connecting port at one time and releases said on-off valve to open while closing said connecting port at another time, an actuator for actuating said valve member, and spring means provided between said housing and said on-off valve biased so as to force said on-off valve in an opening direction.

10. A variable capacity compressor according to claim 1, wherein said electric means includes an electromagnetic valve.

11. A variable capacity compressor according to claim 9, wherein said on-off valve has a narrow connecting hole for connecting said pressure room in said low-pressure chamber.

12. A variable capacity compressor according to claim 11, wherein said electric means includes a servo motor.

13. A variable capacity compressor according to claim 12, further comprising an electric circuit for driving said servo motor for a certain time period in response to a signal to operate said on-off valve.

14. A variable capacity compressor according to claim 13, further comprising a device, to move said on-off valve, which moves forward or backward according to the rotation of said servo motor, said device causing said servo motor to idle when said on-off valve reaches the fore or back end of its movable space.

15. A variable capacity compressor according to claim 14, wherein said on-off valve has a plunger inserted in said pressure room which receives a fluid pressure from said high-pressure chamber, and said device is placed in said pressure room to move said on-off valve directly or indirectly and also to open or close a valve of a connecting port between said high-pressure chamber and said pressure room.

16. A variable capacity compressor according to claim 15, wherein said pressure room and said low-pressure chamber are connected by a narrow connecting slit.

17. A variable capacity compressor, comprising:

plural reciprocating pistons;

a housing including plural cylinder members to respectively support each of said pistons, a low-pressure chamber, a high-pressure chamber and a discharge chamber receiving discharge through discharge ports in some of said cylinder members;

a check valve selectively allowing fluid to flow only from said discharge chamber to said high-pressure chamber;

an on-off valve disposed between said low-pressure chamber and said discharge chamber, and having discharge valves selectively disposable against said discharge ports;

a pressure room formed between said housing and said on-off valve and having a connecting port to connect said pressure room and said discharge chamber; and electric means for selectively closing said on-off valve while opening said connecting port to thereby assist said closing of said on-off valve, and forcing said on-off valve to open while closing said connecting port to thereby permit said opening of said on-off valve, wherein operation of said on-off valve opens and closes said discharge ports to thereby selectively establish connection between said low-pressure chamber and said discharge chamber.

* * * * *